US007406805B1

(12) United States Patent
Larson

(10) Patent No.: US 7,406,805 B1
(45) Date of Patent: Aug. 5, 2008

(54) BANDING BEAD

(75) Inventor: John A. Larson, Parkland, FL (US)

(73) Assignee: Plastic Components, Inc., Miami, FL (US)

( * ) Notice: Subject to any disclaimer, the term of this patent is extended or adjusted under 35 U.S.C. 154(b) by 347 days.

(21) Appl. No.: 11/261,214

(22) Filed: Oct. 28, 2005

(51) Int. Cl.
*E04B 2/00* (2006.01)
*E04F 13/06* (2006.01)
*E04C 2/38* (2006.01)
*E04C 3/30* (2006.01)

(52) U.S. Cl. ..... 52/371; 52/364; 52/717.05; 52/717.06; 52/729; 52/730.2; 52/731.7; 52/738

(58) Field of Classification Search ..... 52/182, 52/364, 371, 589.1, 591.1, 591.2, 591.3, 52/717.05, 717.06, 729, 730.2, 731.7, 738, 52/800.1, 800.11
See application file for complete search history.

(56) References Cited

U.S. PATENT DOCUMENTS 5,423,154 A * 6/1995 Maylon et al. ..... 52/371
5,910,087 A * 6/1999 Carter ..... 52/371
2003/0226320 A1* 12/2003 Engebretson ..... 52/204.5

* cited by examiner

*Primary Examiner*—Richard E. Chilcot, Jr.
*Assistant Examiner*—Branon C Painter

(57) ABSTRACT

A step bead comprising: A) an elongated base having opposed front and back top and bottom longitudinal edges; B) a first rear vertical flange extending upwardly from the top rear longitudinal edge; C) a second rear vertical flange extending downwardly from the bottom rear longitudinal edge; D) a first front vertical flange extending upward from the top front longitudinal edge, generally parallel to the first rear vertical flange and having a first end proximate the top front longitudinal edge and a distal end; E) a longitudinal horizontal flange having a first end proximate the distal end and a second end remote from the distal end and extending from the distal end generally parallel to the base and away from the first rear vertical flange; F) a second vertical flange extending upwardly and downwardly from the second end and having a first top vertical flange end; and G) a third horizontal flange extending inwardly from the top vertical flange end toward the first vertical rear flange but not to the distal end.

2 Claims, 3 Drawing Sheets

BANDING BEAD

FIELD OF THE INVENTION

The present invention relates to construction materials and more particularly to mounting or banding bead for the installation of stucco or the like siding on the exterior of structures.

BACKGROUND OF THE INVENTION

In the installation of stucco finishes and the like to the exterior walls of structures some mechanism is required to support the applied stucco and retain in upon the wall to which it is applied. The devices intended for this purpose are referred to in the art as banding beads.

In recent years, the desire to have "stuccoed" exteriors that more closely resemble siding or clapboard building exterior finishes has led to the development of stucco treatments that do in fact resemble such structural finishes. This development has, in turn, led to the need for banding bead of a somewhat different design to achieve the "layered" look of such exterior finishes. Such modified banding beads are referred to in the art as step bead and a cross-section of one such device is depicted in attached FIG. 1 which is described below. Step bead allows for the application of stucco in a manner that the thickness of the stucco at the top of any single horizontal tier of applied stucco is thinner than that at the bottom or base of such tier thus providing the siding or clapboard look that is common in structures having wood or similar materials applied thereto in a clapboard or horizontal siding arrangement. While step bead of the type shown in FIG. 1 and described in greater detail below has proven satisfactory in the previously described stucco installations, it has also demonstrated a number of shortcomings. Among these are: 1) a lack of secure attachment points for attaching the step bead to the exterior of a structure covered with, for example, plywood or other sheathing; and 2) the presence of a mechanism that inhibits the infiltration of water/moisture between descending layers of step bead having over-applied layers of stucco adhered thereto.

Thus, there remains a need for an enhanced step bead that overcomes these shortcomings of currently commercially available step bead products.

OBJECTS OF THE INVENTION

It is therefore an object of the present invention to provide a step bead that provides a mechanism to simplify the attachment thereof to a structure.

It is another object of the present invention to provide a step bead that includes a mechanism that inhibits the infiltration of moisture/water between descending layers of step bead applied to the exterior of a structure.

SUMMARY OF THE INVENTION

According to the present invention there is provided a step bead comprising: A) an elongated base having opposed front and back top and bottom longitudinal edges; B) a first rear vertical flange extending upwardly from the top rear longitudinal edge; C) a second rear vertical flange extending downwardly from the bottom rear longitudinal edge; D) a first front vertical flange extending upward from the top front longitudinal edge, generally parallel to the first rear vertical flange and having a first end proximate the top front longitudinal edge and a distal end; E) a longitudinal horizontal flange having a first end proximate the distal end and a second end remote from the distal end and extending from the distal end generally parallel to the base and away from the first rear vertical flange; F) a second vertical flange extending upwardly and downwardly from the second end and having a first top vertical flange end; and G) a third horizontal flange extending inwardly from the top vertical flange end toward the first vertical rear flange but not to the distal end.

DETAILED DESCRIPTION

Figure 1:
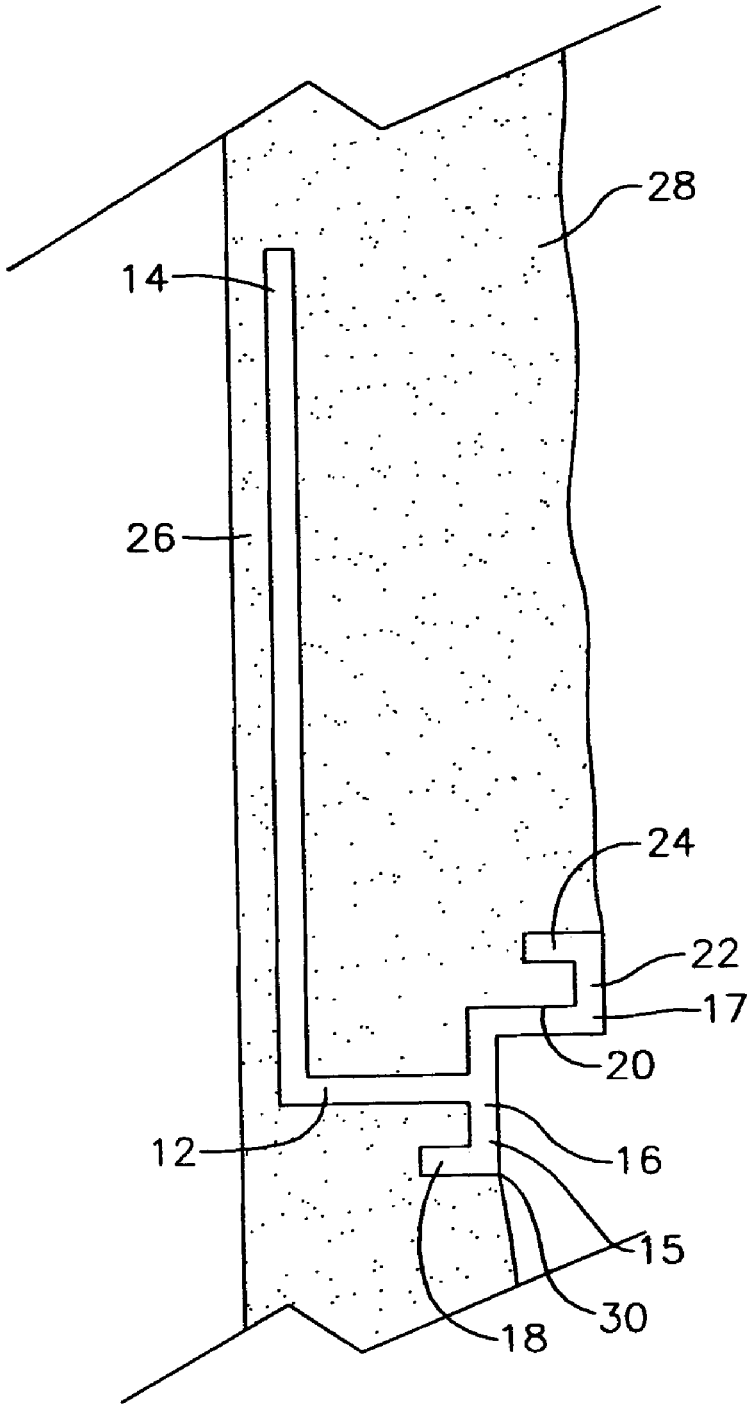
FIG. 1 PRIOR ART
FIG. 1 is a cross-sectional view of the step bead of the prior art.

Referring now to the accompanying drawings, FIG. 1 depicts a cross-sectional view of the step bead of the best known prior art. As seen in FIG. 1, the step bead of the prior art 10 comprises: a base 12; a rear wall 14; a first vertical flange 16 extending upwardly and downwardly from the front edge 13 base 12; a first horizontal flange 18 extending from the lower end 15 end of first vertical flange 16 in the direction of wall 14; a second horizontal flange 20 extending from the upwardly extending end of first vertical flange 16; a second vertical flange 22 extending upwardly from end 17 of second horizontal flange 20, generally parallel to rear wall 14; and a third horizontal flange 24 extending parallel to base 12 in the direction of rear wall 14. As shown in FIG. 1, step bead 10 is applied to a block wall 26. Adhesion of step bead 10 to block wall 26 is largely through the penetration of stucco fill 28 through apertures in rear wall 14, not shown in FIG. 1.

Figure 2:
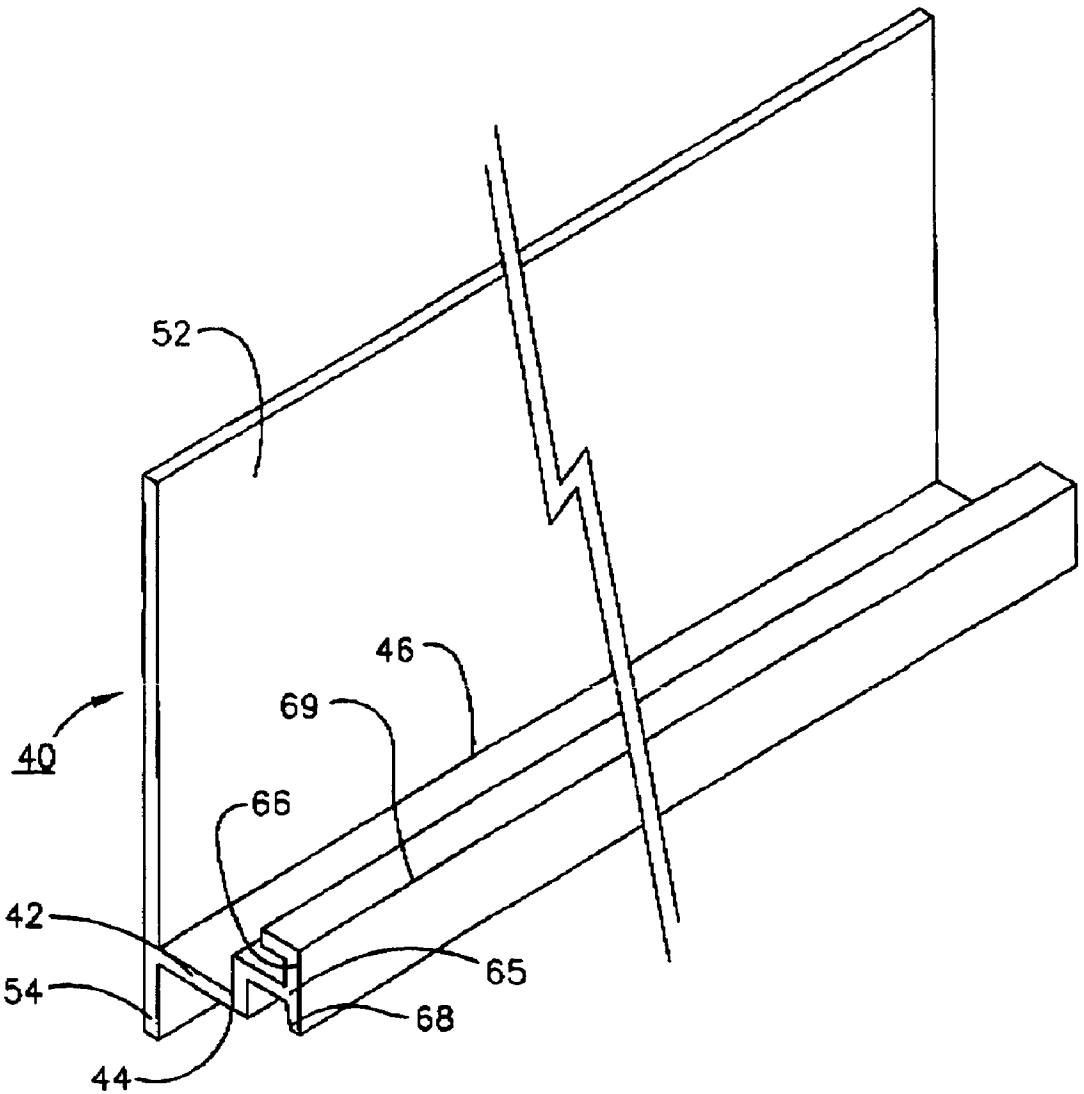
FIG. 2 is a perspective view of the step bead of the present invention.
Figure 3:
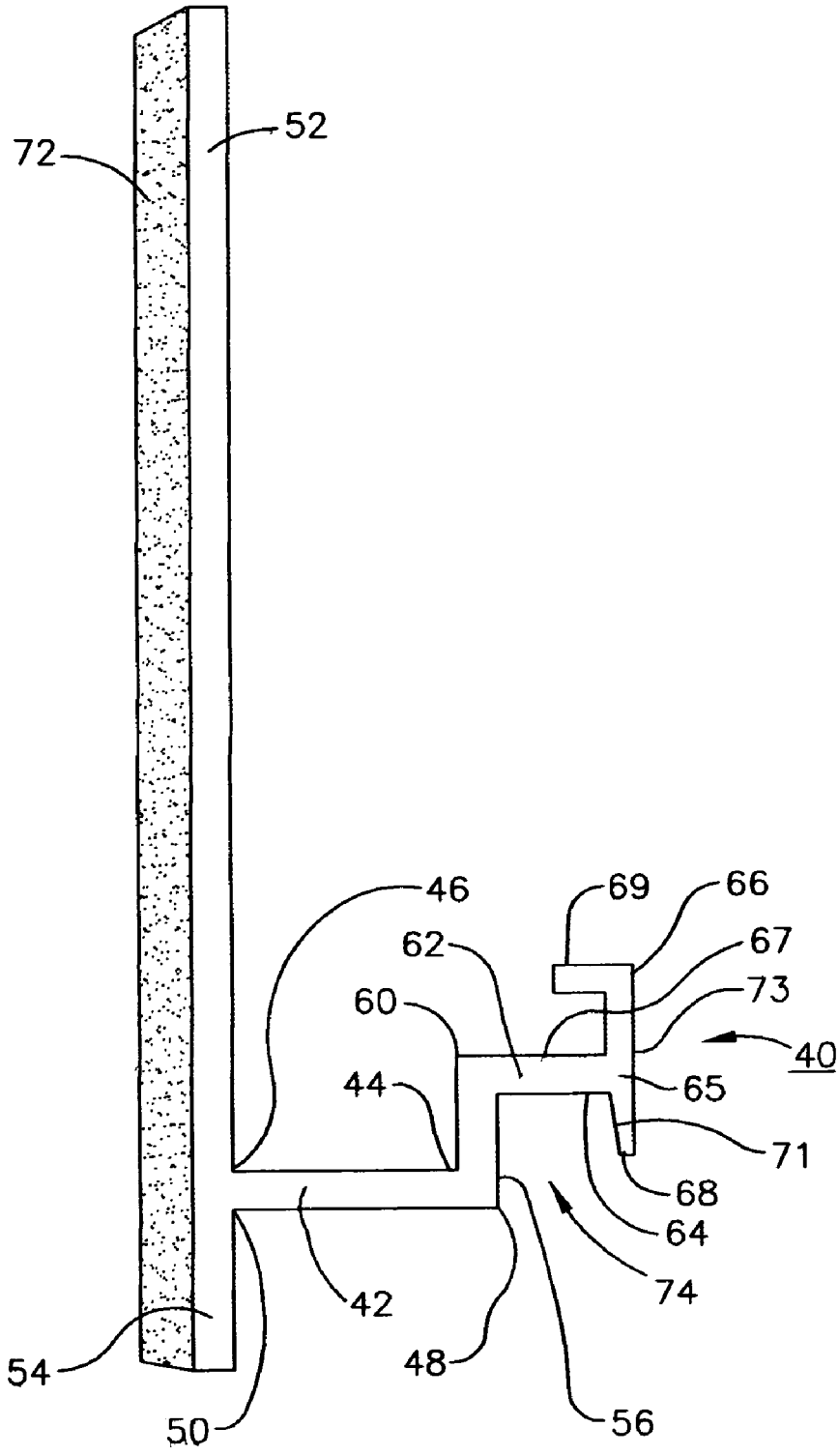
FIG. 3 is a cross-sectional view of the step bead of the present invention.

Referring now to FIGS. 2 and 3 that depict a perspective view and a cross-sectional view of the step bead of the present invention respectively, step bead 40 of the present invention comprises: A) an elongated base 42 having opposed front and back, top and bottom longitudinal edges 44-50; B) a first rear vertical flange 52 extending upwardly from said top rear longitudinal edge 46; C) a second rear vertical flange 54 extending downwardly from bottom rear longitudinal edge 50; D) a first front vertical flange 56 extending upward from top front longitudinal edge 44, generally parallel to first rear vertical flange 52 and having a first end 58 proximate top front longitudinal edge 44 and a distal end 60; E) a first horizontal longitudinal flange 62 having a first end proximate distal end 60 and a second end 64 remote from distal end 60 and extending from distal end 60 generally parallel to base 12 and away from said first rear vertical flange 52; F) a second vertical flange 65 extending upwardly and downwardly from second end 67 and having a first top vertical flange end 66 and a second bottom vertical flange 68; and G) a third horizontal flange 69 extending inwardly from top vertical flange end 66 toward first vertical rear flange 52 but not to distal end 60. As shown in FIG. 3, step bead 40 is applied to an underlying sheathing or other structural element 72. It should be noted that surface 71 of second bottom vertical flange 68 is angled such that it is wider at its top where it abuts first horizontal longitudinal flange 62 than at its distal end. Such a configuration provides assurance that moisture moving down surface 73 does not wick or otherwise enter any portion of step bead 40 or any material contained therein.

An element by element comparison of the structures depicted particularly in FIGS. 1 and 3 shows that the step bead of the present invention includes two elements not present in the prior art step bead depicted in FIG. 1 and excludes one element present in the step bead of the prior art. Specifically, the step bead of the present invention includes second rear vertical flange 54 and second bottom vertical flange 68. The step bead of the present invention does not include that portion of first vertical flange 16 that extends downwardly nor first horizontal flange 18.

Second rear vertical flange 54 serves at least two specific purposes. Firstly, it provides a location for the insertion of fasteners such as nails or screws for the attachment of step bead 40 to an underlying wall of sheathing of one type or another and secondly, and perhaps more importantly, it provides resistance to downward rotation in the direction shown by arrow 70 in FIG. 3 when stucco fill is applied as shown in FIG. 1 in connection with the prior art step bead. In the absence of second rear vertical flange 54, there is little to resist the weight of applied stucco fill and step bead 10 will tend to draw away from block wall 26. With second rear vertical flange 54 in place, there is a mechanism for the insertion of fasteners as well as a structure providing resistance to rotation due to the weight of stucco fill 28 before it has solidified.

Second bottom vertical flange 68 a shown in FIGS. 2 and 3 serves to capture and retain applied stucco fill by defining a cavity 74 between flanges 56, 62 and 68 while also providing a drip edge for the removal of potentially infiltrating water that cascades over the front of flange 64. The absence of such a drip edge in the structure of the prior art depicted in FIG. 1 provides the potential for overrunning moisture to penetrate between flange 16 and stucco fill applied thereto at the joint 30 of FIG. 1.

There has thus been described a novel step bead that includes a variety of highly useful features not present in the step beads of the prior art. Such features, among other things, provide for: 1) resistance to rotation away form a wall to which the step bead is applied; 2) a location for the insertion of fasteners to enhance attachment of the step bead to an underlying wall; 3) a mechanism for enhancing the retention of over-applied stucco; and 4) the provision of a drip edge that assures removal of potentially infiltrating moisture draining down the face of a completed stucco installation.

As the invention has been described, it will be apparent to those skilled in the art that the same may be varied in many ways without departing from the spirit and scope of the invention. Any and all such modifications are intended to be included within the scope of the appended claims.

What is claimed is:

1. A step bead consisting of:

A) an elongated base having opposed front and rear top and bottom longitudinal edges;

B) a first rear vertical flange extending upwardly from said top rear longitudinal edge;

C) a second rear longitudinal and vertical flange extending downward from said bottom rear longitudinal edge;

D) a first front longitudinal vertical flange extending upward from said top front longitudinal edge, generally parallel to said first rear vertical flange and having a first end proximate said top front longitudinal edge and a distal end;

E) a first longitudinal horizontal flange having a first end proximate said distal end and a second end remote from said distal end and extending from said distal end generally parallel to said base and away from said first rear vertical flange;

F) a second bottom vertical flange extending upwardly and downwardly from said second end and having a first top vertical flange end; and G) a second longitudinal horizontal flange extending inwardly from said first top vertical flange end toward said first longitudinal vertical rear flange but not to said distal end.

2. The step bead of claim 1 wherein said second bottom vertical flange, said first longitudinal horizontal flange and said first front vertical flange define a cavity therebetween for the receipt and retention of over-applied stucco fill.

* * * * *